US005591068A

United States Patent [19]

Taylor

[11] Patent Number: 5,591,068

[45] Date of Patent: Jan. 7, 1997

[54] PRECISION NON-CONTACT POLISHING TOOL

[75] Inventor: John S. Taylor, Livermore, Calif.

[73] Assignee: Regents of the University of California, Oakland, Calif.

[21] Appl. No.: 403,035

[22] Filed: Mar. 13, 1995

[51] Int. Cl.[6] ..... B24B 31/00

[52] U.S. Cl. ..... 451/104; 451/111; 451/113; 451/115; 451/527

[58] Field of Search ..... 451/36, 40, 41, 451/42, 102, 104, 108, 111, 112, 113, 115, 527

[56] References Cited

U.S. PATENT DOCUMENTS

| | | | |
|---|---|---|---|
| 232,682 | 9/1880 | Chase | 451/112 |
| 2,755,598 | 7/1956 | Van Denburgh | 451/102 |
| 4,084,535 | 4/1978 | Rees | 451/111 X |
| 4,845,902 | 7/1989 | Bolliand | 451/527 |
| 5,245,796 | 9/1993 | Miller et al. | 451/36 X |

FOREIGN PATENT DOCUMENTS

| | | | |
|---|---|---|---|
| 722748 | 3/1980 | U.S.S.R. | 451/104 |
| 1627277 | 2/1991 | U.S.S.R. | 451/111 |
| 624928 | 6/1949 | United Kingdom | 451/527 |

OTHER PUBLICATIONS

Y. Mori et al, Mechanism of Atomic Removal in Elastic Emission Machining, Precision Engineering, Jan. 1988, vol. 10, No. 1, pp. 24–28.

P. C. Baker, Advanced Flow–Polishing of Exotic Optical Materials, SPIE, vol. 1160, X–Ray/EUV Optics, 1989, pp. 263–270.

J. M. Bennett et al, Float Polishing of Optical Materials, Applied Optics/vol. 26, No. 4/15 Feb. 1987, pp. 696–702.

AMMTRA Brochure, Advanced Material Processing & Machining Unveiling The Technology Of The 21st Century, 1991.

*Primary Examiner*—Timothy V. Eley

*Attorney, Agent, or Firm*—L. E. Carnahan; Henry P. Sartorio

[57] ABSTRACT

A non-contact polishing tool that combines two orthogonal slurry flow geometries to provide flexibility in altering the shape of the removal footprint. By varying the relative contributions of the two flow geometries, the footprint shape can be varied between the characteristic shapes corresponding to the two independent flow regimes. In addition, the tool can include a pressure activated means by which the shape of the brim of the tool can be varied. The tool can be utilized in various applications, such as x-ray optical surfaces, x-ray lithography, lenses, etc., where stringent shape and finish tolerances are required.

17 Claims, 2 Drawing Sheets

PRECISION NON-CONTACT POLISHING TOOL

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention is related to polishing tools, particularly to non-contact polishing tools, and more particularly to a non-contact polishing tool having adjustable removal footprint geometry by the use of a plurality of orthogonal slurry flow geometries.

Technology for manufacturing surfaces to precision tolerances is critical in fields such as inertial confinement fusion (ICF), x-ray lithography, camera lenses, and various other optical devices. It is estimated that the world-wide market for such optical devices will be in the billions of dollars. Also, the availability of highly accurate aspheric optics is a key to future reductions in semiconductor line widths via projection lithography.

Several new optical figuring technologies are being developed throughout the world to eliminate the poor repeatability and high cost associated with traditional pitch polishing. Ion beam figuring (IBF) and plasma-assisted chemical etching (PACE) both have controllable removal footprints that may be applicable for high accuracy figuring, but both require expensive vacuum systems and are applicable only to limited sets of materials. For example, IBF has been very successful during the final figure corrections of the Keck Telescope segments. Ductile-mode grinding shows promise as a deterministic shaping process for producing smooth damage-free surfaces, but it has not yet been demonstrated to produce highly accurate aspheric surfaces that do not require post-polishing, particularly in fused silica. Stressed-lap and stressed-part lapping are currently being used with good success for figuring large telescope optics, but have not been applied to the much smaller optics, especially with respect to the tolerances and spatial wavelengths of relevance to lithographic optics.

Elastic emission machining (EEM), see Y. Mori et al., "Mechanism of Atomic Removal in Elastic Emission Machining", Precision Engineering, January 1988, Vol. 10, No. 1, pp 24–28; flow polishing, see P.C. Baker, "Advanced Flow-Polishing of Exotic Optical Materials", X-Ray/EUV Optics for Astronomy and Microscopy, SPIE, Vol. 1160, 263–270 (1989); and float polishing, see J. M. Bennett et al., "Float Polishing of Optical Materials", Applied Optics, 26(4), 696–703 (1987), are all non-contact polishing techniques that may produce minimal subsurface damage. They all utilize the same fundamental material removal process: a fluid dynamic flow field is established to carry a fine abrasive slurry to the optical surface which transports away material by a sufficiently gentle transport mechanism that does not disrupt the structure of the surface layers. In one form or another, these processes are currently being used to prepare aspheric surfaces. An EEM approach is being developed to figure aspheric surfaces in support of the Advanced Processing and Machining Technology Research Association (AAMTRA), see the "Advanced Material Processing & Machining: Unveiling the Technology of the 21st Century", AAMTRA brochure describing the consortium's approach for soft x-ray lithography, members include Cannon, Toshiba, Nikon, Hitachi, etc., c. 1991.

While the non-contact polishing techniques of the above-referenced optical finishing strategies, have strengths and weaknesses for aspheric optics, there is a need for a non-contact, polishing approach which utilizes the strengths of these prior strategies, but eliminates the weakness thereof. This need is satisfied by the present invention which combines two orthogonal slurry flow geometries to provide flexibility in altering the shape of the removal footprint. The invention provides a non-contact polishing tool that will meet stringent shape (figure) and finish (roughness) tolerances on precision surfaces during their fabrication. The tool is particularly useful for surfaces that have very tight geometrical shape tolerances.

SUMMARY OF THE INVENTION

It is an object of the present invention to provide a non-contact polishing tool.

A further object of the invention is to provide a non-contact polishing tool with an adjustable removal footprint geometry.

Another object of the invention is to provide a non-contact polishing technique that utilizes multiple independently-adjustable fluid mechanic mechanisms to control the shape of the removal footprint on the surface being polished.

Another object of the invention is to provide a non-contact polishing tool that combines two orthogonal slurry flow geometries to provide flexibility in altering the shape of the removal footprint.

Another object of the invention is to provide a subaperture polishing tool for making very precise corrections to general aspheric contours and for removing higher order refractive index errors in transmission optics, for example, and thus reduce the cost of fabricating high quality aspheric optics.

Other objects and advantages will become apparent from the following description and accompanying drawings. The invention involves a non-contact polishing tool with an adjustable removal footprint geometry, that can meet stringent shape (figure) and finish (roughness) tolerances on precision surfaces during their fabrication. The tool is particularly applicable for surfaces that include x-ray optical surfaces that have very tight geometrical shape tolerances. Because this tool uses multiple independently adjustable fluid mechanic mechanisms to control the shape of its removal footprint, several operating parameters are available to the machine operator for varying the relative influences of these fluid mechanic mechanisms. This provides a unique level of flexibility in controlling the shaping characteristics of this non-contact polishing tool.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 1:
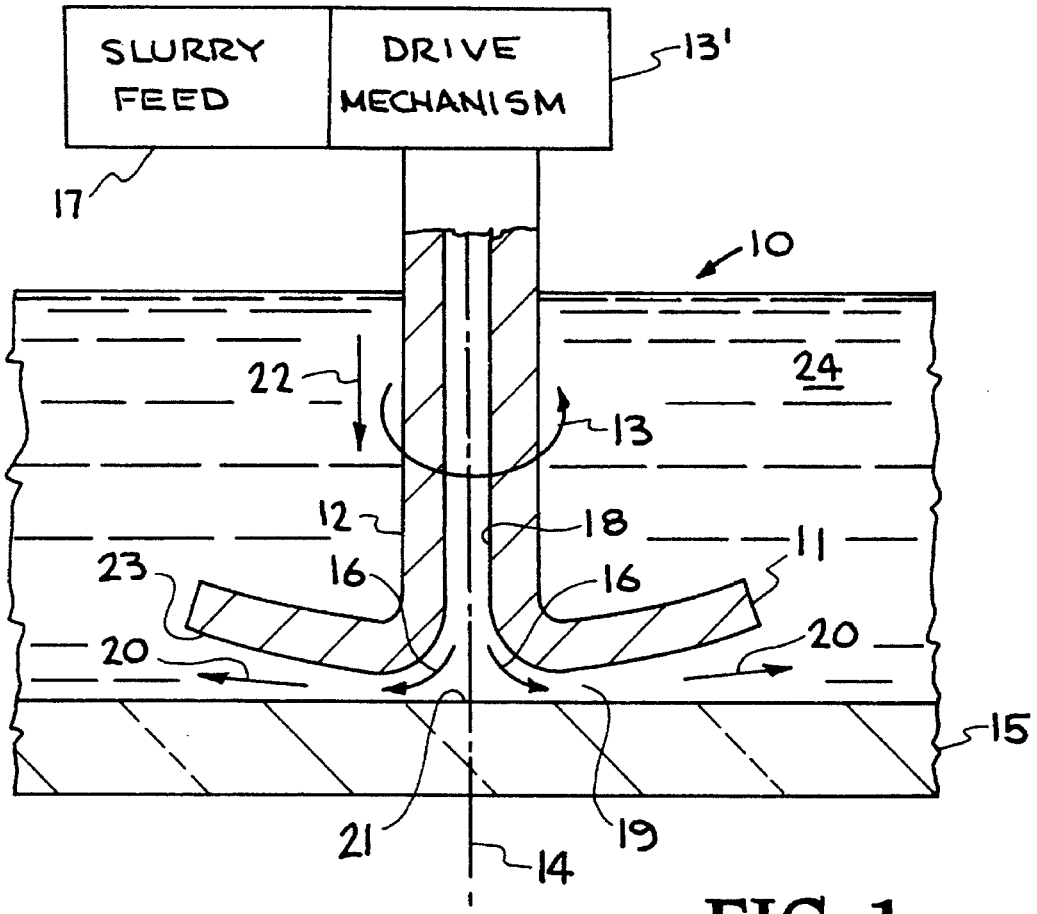
FIG. 1 is a partial cross-sectional view of an embodiment of the polishing tool of the invention, and illustrating schematically the constrained jet slurry flow.

The present invention involves a precision non-contact polishing tool with an adjustable removal footprint geometry. This tool combines two orthogonal slurry flow geometries to provide flexibility in altering the shape of the removal footprint.

Footprint shape is important for predicting the removal behavior of the tool as it traverses the entire optic being fabricated. In general, the amount of removal at a given point on the optic is determined by the amount of removal contributed from all of the positions of the tool. This is known as a convolution relationship. From the desired amount of material to be removed over the surface, the path of the tool over the surface, and the shape of the footprint, the speed of the tool (or dwell time) can be calculated to minimize the remaining errors. Mathematically, this is known as deconvolution. The ability to do this depends in general on the shape of the removal footprint of the polishing tool. The more "well-behaved" and smoother the footprint function is, the easier will be the deconvolution calculation. The tool of this invention provides a footprint shape amenable to deconvolution, due to its adjustable removal footprint capability.

The primary purpose of this invention is to provide a polishing tool capable of reducing the cost of fabricating high quality aspheric optics. Small subaperture tools are necessary for making very precise corrections to general aspheric contours and for removing higher-order refractive index errors in transmissive optics. This tool can be used for optics whose initial errors are about $\lambda/10$ rms (HeNe) and improving them to tolerances better than $\lambda/200$ rms for spatial wavelengths greater than about 2 mm. Larger versions of the tool may be well-suited to larger errors and longer spatial wavelengths. To accomplish this the polishing tool should have certain attributes, and the key attributes of an ultra-precise figuring tool for aspheric optics, are as follows:

1. A well-controlled, temporally-stable removal footprint.
2. A footprint function suitable for deconvolution calculations (e.g. gaussian) for determining optimal traverse paths over the optical surface.
3. An adjustable footprint shape and removal rate for accommodating different error profiles on a wide range of aspheric contours.
4. A footprint function that can correct errors for key spatial wavelengths without introducing errors in other wavelength bands.
5. A process that can be used on a wide variety of materials.
6. A process that introduces little or no subsurface damage.
7. A system that does not require large capital investments.
8. A system that has a significantly lower production cost than traditional methods.

The non-contact polishing tool of this invention can meet all of the criteria listed above, because it combines two orthogonal slurry flow geometries to provide flexibility in altering the shape of the removal footprint. By varying the relative contributions of the two components, the footprint shape can be varied between the characteristic shapes corresponding to the two independent flow regimes.

Figure 3:
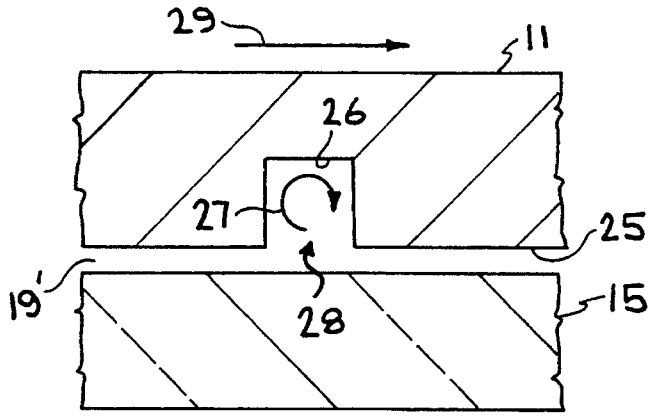
FIG. 3 illustrates the driven cavity flow in the radial grooves of FIG. 2 formed by rotation of the tool.

The characteristic flow contributions consist of a constrained radial stagnation flow (wall jet) and one or more rotationally-driven flows, as shown in FIGS. 1 and 3, described in detail hereinafter. The stagnation flow is formed when slurry flowing axially through the shaft of the polishing tool impinges on the optical surface and is constrained to flow radially between the optical surface and the brim or disk of the tool. The flow characteristics of this stagnation flow depend upon the precise shape of the brim, the location of the minimum gap between the brim and the optical surface, the traction force applied axially to the tool, and the slurry feed pressure. The material removal will be enhanced at the location of maximum shear stress which should occur at the location of the minimum gap. Note that the gap may be small at more than one radial location.

Figure 2:
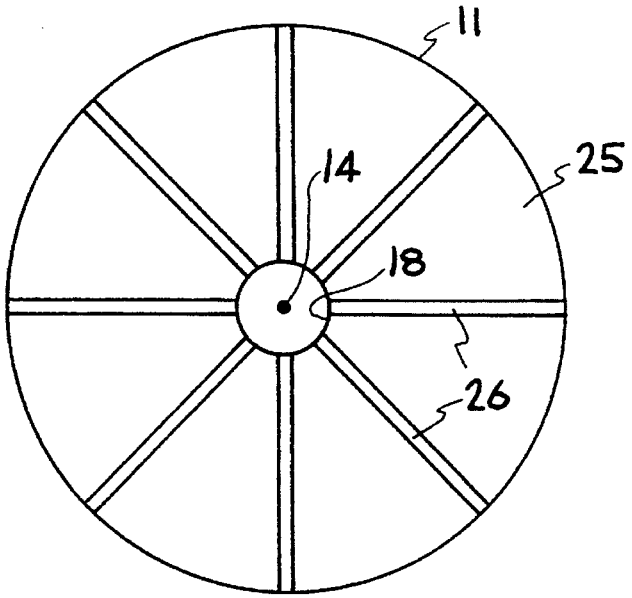
FIG. 2 is a partial end or bottom view of the FIG. 1 tool illustrating the radial grooves in the disk or brim thereof which extend partially along the surface.
Figure 5:
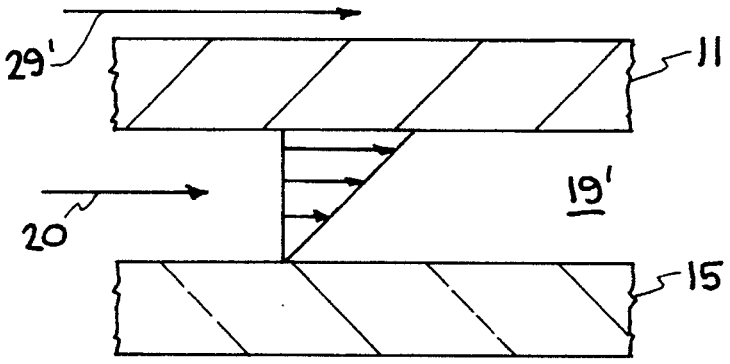
FIG. 5 is a partial cross-sectional view of the slurry flow geometry for an embodiment without radial grooves, and for the zones between the grooves.

The bottom surface of the disk or brim may be non-continuous, e.g. toughened or provided with radial grooves formed therein, as shown in FIG. 2, to enhance the agitation of the slurry or modify the shear stress distribution. As the tool rotates, it causes an azimuthal flow component that is essentially orthogonal to the radial stagnation flow. As shown in FIG. 3, if grooves are present, they may provide for a driven cavity flow to form within these radial grooves. This cavity flow will augment the tendency of the abrasive particles in the slurry to interact with the optical surface, thus contributing to the shape of the removal footprint. Note that the grooves may having a variety of contour shapes, such as square, semi-circular, etc. The magnitude of this cavity removal contribution will depend on the strength and radial extent of the cavity flow, which should be a function of the gap, the rotational speed, and the groove dimensions. In addition, either in the absence of grooves, or between the grooves, a shear flow forms that is dependent upon the rotational speed and separation. This shear flow will augment the material removal by driving the abrasives in an azimuthal flow, and such a shear flow is shown in FIG. 5.

The non-contact polishing tool of this invention has similarities to the flow polishing and float polishing techniques, referenced above. However, the constrained jet will be more stable than the free impinging jet of these prior approaches, and provide the additional control offered by varying the ratio of the traction force to the supply pressure. The azimuthal flow offers the Angstrom-level smoothing reported for float polishing, but can be applied to aspheric surfaces.

The ability to vary the relative contribution of the two flow regimes may only be possible if their nominal Reynolds numbers are similar and can be independently varied. For supply pressures in the range of 100–500 psi, rotational speeds of 100–1000 rpm, and a minimum gap between the brim and the optical surface of 50 microns at a radius of 3 mm from the axis of the brim, the Reynolds number based on the stagnation flow ranges from about 18–40; the Reynolds number based on the driven cavity at a radius of 6 mm from the axis of the brim ranges from 1.2–12. Therefore, for these cases which are based on simple assumptions, the Reynolds numbers suggest comparable degrees of control for the two components.

Referring now to the embodiment of the invention illustrated in the drawings, as shown in FIG. 1, the non-contact polishing tool, generally indicated at 10, comprises a disk or brim 11 integral with a hollow, axial shaft 12 and spinning or rotating as indicated at 13 about an axis 14, that is perpendicular to a surface 15 being fabricated, such as an optical component, the brim 11 being rotated via a drive mechanism indicated at 13'. A jet 16 of fine abrasive slurry from a slurry feed 17, having a pressure (P) and flow rate (Q), is emitted through an orifice or opening 18 of hollow, axial shaft 12 at the center of the brim 11. The slurry jet is constrained between the brim 11 and surface 15 by a limiting orifice or gap, indicated at 19, which causes it to flow radially outward, as indicated at 20, which creates a stagnation flow at the surface 15 near axis 14, as indicated at 21. The width of the limiting orifice 19 will be determined by at least the thrust force, on the tool 10, indicated at 22, and the shape function of brim 11, indicated at 23, as described in greater detail hereinafter. As shown in FIG. 1, the tool 10 is fully submerged in a slurry 24, but it may be operated by simply letting the slurry run off the surface 15.

Figure 4:
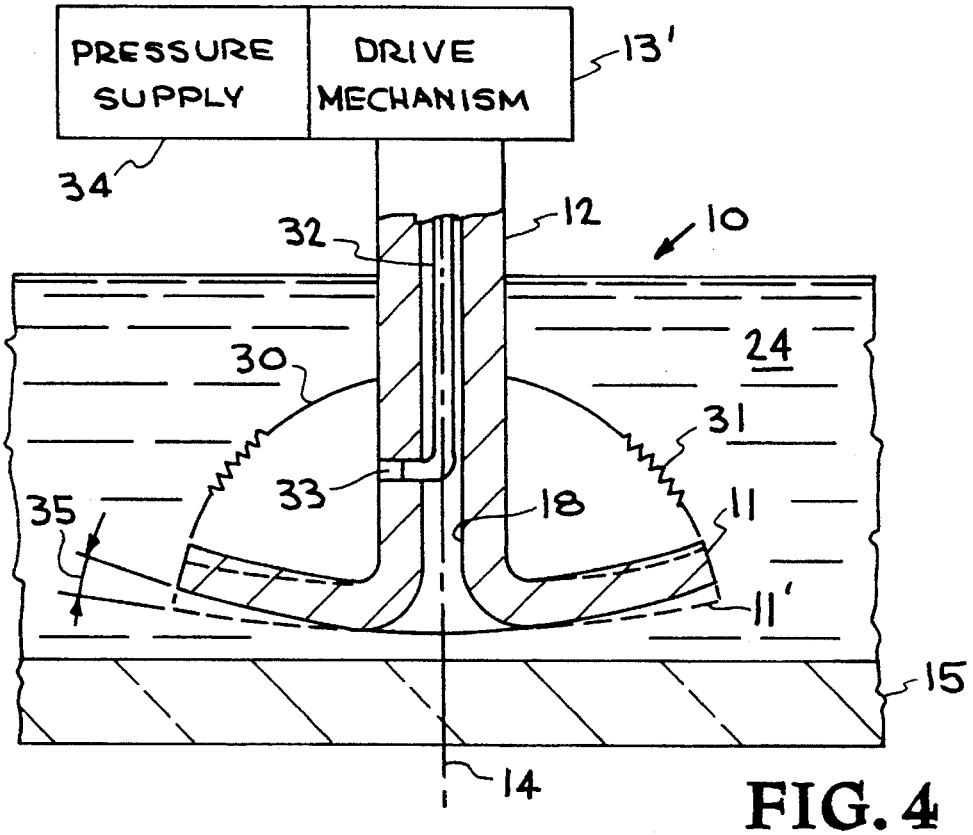
FIG. 4 is a schematic view of an embodiment of the polishing tool of FIG. 1 with a fluid pressure control mechanism for shaping the brim or disk.

Based on an analysis, it appears that the material removal will be greatest in a radial range where the shear stress of the fluid (slurry) is greatest on the surface 15, namely, at the limiting orifice or gap 19; the removal will decrease away from this annular location, indicated in FIG. 1 by the limiting orifice 19. The location of maximum removal is dependent on the geometry of the bottom of the brim 11; this is a design parameter that can be chosen by the machine operator or engineer to fit the application, and FIG. 4 illustrates an approach for an active means of controlling brim shape during operation, as will be described in detail hereinafter. The fact that the slurry jet 16 is constrained as indicated at 20 between the brim 11 and surface 15 contributes to a stable fluid flow.

As shown in FIG. 2, the bottom side or end 25 of the brim 11 of tool 10 may be provided with equally spaced radial grooves 26, only three shown, or such grooves may be omitted as in the FIG. 5 embodiment. The polishing tool 10 will be rotated about its axis 14 and will cause a recirculating "cavity flow" within each of the grooves 26 as shown in FIG. 3 and indicated at 27, and forms a driven cavity 28 in the bottom 25 of brim 11. Material removal from surface 15 may be enhanced by the vertical component of the cavity flow 27 which bring the fine abrasives in the slurry to the surface 15. The abrasive slurry for the cavity flow 27 is the same slurry supplied via the stagnation flow 21 in FIG. 1. Note that both the cavity flow and the stagnation flow removal mechanisms operate at the same time, by rotation of the tool 10 at a speed to produce a desired sheath velocity, indicated at 29 in FIG. 3, creating the driven cavity 28, as radial grooves 26 move with respect to surface 15, and with the space between the bottom 25 of brim 11 and optical surface 15 forming a gap 19' there between. As pointed out above, the magnitude of the driven cavity removal contribution will depend on the strength and radial extent of the cavity flow 27, which is a function of the gap, the rotational speed, and the radial groove dimensions.

An important flow geometry exists between the grooves, or in the case of no grooves at all, see FIG. 5. The slurry is subjected to a shear flow that amplifies material removal by the abrasives. The strength of this shear flow is determined by the rotational speed of the tool and the size of the gap separating the tool from the optical surface.

Polishing with the tool of this invention is referred to as "non-contact" polishing because the tool 10 does not touch the surface 15; instead, it only acts as a controlling mechanism for supplying slurry to the surface of the object to be polished with the appropriate fluid mechanic conditions. Non-contact polishing is considered to produce much less subsurface damage than traditional polishing techniques because the action of the abrasive on the surface being polished is much more gentle. In fact, the actual physical removal mechanism seems to be more chemical than mechanical; this is typically referred to as mechano-chemical polishing and may signify stress-induced chemistry. The mechanical aspects of non-contact polishing are necessary for controlling the fluid momentum of the slurry and the location of where the removal takes place. Location control is the key issue addressed here with respect to precision shaping operations. The separation or gap 19(19') between the tool and the surface is maintained by hydrodynamic and hydrostatic forces due to rotation of the tool 10 and the slurry jet 16 impinging on the surface 15. The axial or thrust force 22 applied to the tool shaft 12 is a variable that influences the separation gap 19(19').

The relative contributions of the stagnation flow 21 and the rotational flow 27 mechanisms are determined by the operating and design parameters that influence each flow mechanism. Tool rotational speed, separation gap, number of radial grooves in the brim, and groove geometry all influence the azimuthal flow 27; while brim geometry, slurry flow rate (Q), slurry supply pressure (P), location of the limiting orifice, and the axial or thrust force influence the stagnation flow 21. As an example, the relative contribution of the two mechanisms may be controlled by the operator by varying the rotational speed with respect to the slurry pressure and the axial or thrust force.

FIG. 4 schematically illustrates an embodiment of an active control for shaping or adjusting the brim of the polishing tool comprising a pressure activated assembly. In this embodiment, the pressure activated assembly includes a canopy 30 having a flexible section, such as a bellows 31 therein, is secured to the brim 11 of tool 10 and extends around axial shaft 12 in a fluid sealed relation, but which allows the shaft 12 to rotate. A tube or line 32 extends partially through orifice or opening 18 of axial shaft 12, with an inner end 33 thereof extending through the wall of axial shaft 12 and terminating within canopy 30, with an outer end of tube 32 being connected to a controlled auxiliary pressure supply, as indicated at 34, which may be water, oil, or a gas. The brim 11 of tool 10 is fabricated out of a relatively elastic material, such as metal, polyurethane, and fiber-reinforced composites that will flex, but must be compatible with the composition of the slurry being used. By varying the pressure in the canopy region, via the controlled auxiliary pressure supply 34 and tubes 32–33, the brim 11 will flex either downward (towards the surface 15) with an increase in pressure within canopy 30, or upward (away from the surface 15) with a decrease in pressure in canopy 30, with the downward deflection of the brim 11 being indicated at 35, and with the downward (pressurized) position of the brim being indicated at 11' by dashed lines. This flexing might be desired for the removal footprint of the tool 10 to be adjusted because changing the shape of the brim 11 will affect the velocity of the slurry as it passes between the brim 11 and surface 15, due to a change in the width of limiting orifice 19 (FIG. 1) and/or the gap 19' (FIG. 3), and thus the shear stress along the surface 15, as a function of the radius of the brim 11. Note that the exact shape of the flexing brim (11–11') is a design parameter, because its rigidity can be tailored by varying its thickness as a function of its radius: the thinner sections will tend to bend more than thicker sections.

By way of example, the brim 11 of tool 10 may be constructed of metal, plastic, or composite, with a radius of 5 mm to 20 mm from axis 14, and a thickness of 1 mm to 5 mm, and the outer end of the brim may be tapered so as to have a thickness of 1 mm to 3 mm; the axial shaft 12 may be constructed of metal with the orifice or opening 18 having a diameter of 1 mm to 5 mm; the radial grooves 26 may be in number from 0 to 50, having a depth of 0 to 3 mm and width of 0 to 3 mm; the canopy 30 may be constructed of metal or fiber reinforce composite sealed around axial shaft 12 by epoxy or brazing or clamps secured to brim 11 by epoxy or brazing; with the bellows 31 being of the same material as canopy 30, or made of polyurethane. The fluid seal between shaft 12 and canopy 30 may include an O-Ring mounted in a groove in either shaft 12 or canopy 30. The auxiliary pressure supply 34 may vary from 0 to 100 psi, and the outer edge of the brim 11 may be deflected about 0 to 2 mm, depending on the construction (material and configuration) of the brim 11. The radius of the limiting orifice 19 may vary from about 1 mm to about 10 mm, with a preferred radius of 3 mm, and the separation gap 19' may vary from 0.002 mm to 0.100 mm with a preferred width of 0.020 mm. With the optical surface 15 being composed of glass, the radius of the brim 11 being 20 mm, the diameter of the orifice 19 being 2 mm, the rotation speed being 500 rpm (range of 100–1000 rpm), the composition of the slurry may be aqueous, colloidal, or particulate with a slurry feed pressure (P) of 150 psi (50–500 psi) and a flow rate (Q) of 0.01–0.1 gm.

It has thus been shown that the non-contact polishing tool of this invention utilizes a combination of different fluid mechanic mechanisms, with each of the mechanisms being generally similar to mechanisms employed by prior known polishing techniques, such as referenced above (EEM, flow polishing, and float polishing). Nevertheless, the geometry of the polishing tool of this invention is unique in the combination of different fluid mechanisms and the control of these fluid mechanisms to provide adjustability, selectability, and control of removal footprint shapes. This provides a unique level of flexibility in controlling the shaping characteristics of this polishing tool. Also, additional fluid mechanics may be involved which have not been fully considered.

The non-contact polishing tool of this invention, thus may be utilized in various applications such as for fabricating optical surfaces, x-ray lithographic optics, or lenses for ICF, as well as for commercial quality lenses, e.g. for cameras, or any application requiring stringent shapes (figures) and finish (roughness) tolerances on precision surfaces during their fabrication. This invention has the capabilities for use in computer-controlled polishing, wherein the computer would determine the width of the limiting orifice and/or separation gap and activate the auxiliary pressure supply to obtain a desired deflection of the brim and thus control the removal footprint shape and location such that the desired removal at any given point on the optic surface, or other surface, may be accomplished. Computer controls are geneally used for convolution type polishing operations where computer algorithms calculate optimum traverse speeds and polishing paths.

While not shown, the mechanism of FIG. 1, for example, may be mounted so as to enable it to have orbital motion as well as rotary motion, whereby the apparatus moves around a second axis, one being eccentric to the other. In addition, the device may be constructed so as to substantially eliminate deflection as shown in FIG. 4.

While a particular embodiment has been illustrated and described, and particular parameters, materials, pressures, speeds, etc. have been set forth to fully describe and exemplify the non-contact polishing tool of this invention, such are not intended to be limiting. Modifications and changes may become apparent to those skilled in the art, and it is intended that the invention be limited only the scope of the appended claims.

I claim:

1. A non-contact polishing tool, comprising:

a brim;

a shaft connected to said brim and having an opening therein;

means for directing a slurry through said opening in said shaft;

means for rotating at least said brim; and means for changing at least the shape of an outer periphery of said brim;

whereby a slurry is adapted to flow through said opening in said shaft and onto an associated surface to be polished.

2. The non-contact polishing tool of claim 1, wherein said brim is provided with a roughened lower surface.

3. The non-contact polishing tool of claim 1, additionally including a plurality of radially extending grooves on a lower surface of said brim, and wherein the slurry is adapted to flow through said grooves and onto an associated surface to be polished.

4. The non-contact polishing tool of claim 1, wherein said means for changing the shape of said brim comprises a pressure activated assembly.

5. The non-contact polishing tool of claim 4, wherein said pressure activated assembly, includes a flexible member secured to said brim and means for connecting said flexible member to a controlled pressure supply.

6. The non-contact polishing tool of claim 5, wherein said flexible member is composed of a canopy having a bellows therein, said canopy being secured to said brim and fluid sealed with respect to said shaft by means which allows rotation of said shaft.

7. The non-contact polishing tool of claim 1, wherein said brim is constructed of flexible material selected from the group consisting of metal, plastic, and fiber-reinforced composite material.

8. The non-contact polishing tool of claim 1, wherein said opening in said shaft defines an axially extending orifice there through.

9. The non-contact polishing tool of claim 8, wherein said means for changing the shape of said brim includes a pressure activated assembly for deflecting at least the outer periphery of said brim.

10. A precision non-contact polishing tool having an adjustable removal footprint geometry, comprising:

a brim having a non-continuous bottom surface thereof;

a shaft connected to the brim and having an axially extending opening therein, and in fluid communication with said grooves in said brim;

means for rotating the shaft and brim; and means for deflecting at least an outer portion of said brim, for adjusting the removal footprint geometry of the brim.

11. The polishing tool of claim 10, wherein at least said brim is constructed of a flexible material.

12. The polishing tool of claim 10, wherein said means for deflecting at least an outer portion of said brim includes a controlled pressure activated assembly.

13. The polishing tool of claim 12, wherein said controlled pressure activated assembly includes a member secured to said brim and fluid sealed about said shaft, and means for connecting an interior of said member with a controlled pressure source.

14. The polishing tool of claim 13, wherein said member comprises a canopy having a flexible section therein.

15. The polishing tool of claim 10, additionally including means for directing a slurry through said axially extending opening in said shaft onto an associated surface to be polished adapted to be positioned in spaced relation to said bottom surface of said brim, directing the slurry into the non-continuous surface on said brim and onto an associated surface to be polished;

whereby stagnation flow and azimuthal flow of the slurry is produced for removing material from an associated surface.

16. The polishing tool of claim 15, wherein said non-continuous surface is selected from a roughened surface and radially extending grooves.

17. The polishing tool of claim 10, additionally including means to enable orbital motion thereof.

* * * * *